United States Patent [19]

Yoshikawa et al.

[11] Patent Number: 5,050,483

[45] Date of Patent: Sep. 24, 1991

[54] FLOW CONTROL DEVICE

[75] Inventors: Kouzou Yoshikawa, Kobe; Takahiro Kobayashi, Himeji, both of Japan

[73] Assignees: Kabushiki Kaisha Kobe Seiko Sho; Nippon Air Brake Co., Ltd., both of Kobe, Japan

[21] Appl. No.: 553,604

[22] Filed: Jul. 18, 1990

[30] Foreign Application Priority Data

Aug. 10, 1989 [JP] Japan ..... 1-208989

[51] Int. Cl.[5] ..... F15B 11/08

[52] U.S. Cl. ..... 91/442; 91/446; 91/448; 91/452

[58] Field of Search ..... 91/442, 444, 446, 448, 91/468, 432, 449, 452; 60/468, 493, 494

[56] References Cited

U.S. PATENT DOCUMENTS

| | | | |
|---|---|---|---|
| 3,171,331 | 3/1965 | Samuel | 91/448 X |
| 3,911,942 | 10/1975 | Becker | 91/446 X |
| 4,078,475 | 3/1978 | Fillion | 91/452 X |
| 4,282,898 | 8/1981 | Harmon et al. | 91/446 X |
| 4,417,502 | 11/1983 | Shore | 91/452 X |
| 4,418,794 | 12/1983 | Manco | 91/448 X |
| 4,706,549 | 11/1987 | Inogaki et al. | 91/448 |
| 4,800,990 | 1/1989 | Blain | 91/452 X |

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A flow control device includes a control valve having a discharge line to be connected to a hydraulic motor, a supply line to be connected to a hydraulic pump, a first bleed-off control passage having a line connected to a tank, and a second bleed-off control passage having a line connected to the tank through a secondary control valve, a flow dividing valve provided in the supply line and having a first position for allowing a first desired flow of oil discharged from the hydraulic pump and a second position for allowing a second desired flow of the oil, and a selector valve operable for the secondary control valve and the flow dividing valve and having a first selection position for closing the secondary control valve and shifting the flow dividing valve to the first position and a second selection position for opening the secondary control valve and shifting the flow dividing valve to the second position.

2 Claims, 3 Drawing Sheets

FLOW CONTROL DEVICE

BACKGROUND OF THE INVENTION AND RELATED ART STATEMENT

This invention relates to a flow control device for use in construction equipments or the like, particularly to a flow control device capable of providing two classes of oil flow.

A conventional flow control device will be described with reference to FIGS. 2 and 3. As shown in FIG. 2, in the conventional flow control device, a pump 1 is communicated with a hydraulic motor 4 through a flow dividing valve 2 and a control valve 3. The flow dividing valve 2 is adopted for controlling the flow of oil supplied to the control valve 3. The control valve 3 is adopted for controlling the direction and flow of oil supplied to the hydraulic motor 4.

The flow dividing valve 2 has a first position 2A in which the whole flow of oil discharged from the pump 1 is supplied to the control valve 3, and a second position 2B in which a portion of oil discharged from the pump 1 is supplied to the control valve 3 and the remaining portion is discharged to a tank T0. In addition, the flow dividing valve 2 has a pilot port 2C to which a pilot line 2F is connected, and springs 2D and 2F. The pilot port 2C is communicated with the tank T0 through the pilot line 2F having a selector valve 6. A portion of oil flowed into the flow dividing valve 2 is supplied to the pilot line 2F as pilot oil, so that when the pilot line 2F is disconnected from the tank T0 by the selector valve 6, the flow dividing valve 2 is shifted from the first control position 2A to the second position 2B, when the pilot line 2F is communicated with the tank T0 by the selector valve 6, the flow dividing valve 2 is shifted from the second position 2B to the first control position 2A.

The control valve 3 has a neutral position 3A in which both a line between the hydraulic motor 4 and the pump 1 and a line between the hydraulic motor 4 and the tank T0 are closed, and a bleed-off control passage 3F is opened, a first control position 3B in which both the line between the hydraulic motor 4 and the pump 1 and the line between the hydraulic motor 4 and the tank T0 are opened, and the bleed-off control passage 3F is throttled, and a second control position 3C in which both the line between the hydraulic motor 4 and the pump 1 and the line between the hydraulic motor 4 and the tank T0 are opened, and the bleed-off control passage 3F is closed.

Indicated at 7 is a bleed-off line for communicating the bleed-off control passage 3F with the tank T0. Indicated at 3B' and 3C' are reverse first and second control positions having the same functions as the first and second control positions 3B and 3C but the reverse flow directions to the first and second control positions 3B and 3C.

In the above-mentioned conventional construction, when the pilot line 2F is closed by the selector valve 6, the flow dividing valve 2 is shifted to the second position 2B, so that a portion of oil discharged from the pump 1 flows to the tank T0 and the remaining portion flows to the control valve 3.

In this state where the flow dividing valve 2 is in the second position 2B, the control valve 3 is shifted to the first control position 3B from the neutral position, the flow of oil supplied to the hydraulic motor 4 is controlled by throttling the bleed-off control passage 3F.

This flow control corresponds to a portion J1 of a performance curve J shown in FIG. 3.

Further, when the control valve 3 is shifted to the second control position 3C, the whole flow of oil supplied from the flow dividing valve 2 is supplied to the hydraulic motor 4. This flow control corresponds to a portion J2 of the performance curve J.

Also, in another state where the flow dividing valve 2 is shifted to the first control position 2A by opening the pilot line 2F, and the whole of oil discharged from the pump 1 flows to the control valve 3, when the control valve 3 is shifted to the first control position 3B from the neutral position, similarly, the flow of oil supplied to the hydraulic motor 4 is controlled by throttling the bleed-off control passage 3F. This flow control corresponds to a portion K1 of a performance curve K shown in FIG. 3. Further, when the control valve 3 is shifted to the second control position 3C, similarly, the whole flow of oil supplied from the flow dividing valve 2 is supplied to the hydraulic motor 4. This flow control corresponds to a portion K2 of the performance curve K.

Accordingly, the speed of the hydraulic motor 4 is controlled by the control valve 3 in accordance with the portions J1 and J2 of the performance curve J, and the portions K1 and K2 of the performance curve K.

The bleed-off control passage 3F has a controllable range between a full-opening position S0 and a full-throttling position S1. When the bleed-off control passage 3F is in the full-opening position S0, the bleed-off control passage 3F is fully opened so that the whole flow of oil discharged from the flow dividing valve 2 which is in the first position 2A is permitted to flow to the tank T0 through the bleed-off line 7 and no oil is supplied to the hydraulic motor 4. On the other hand, when the bleed-off control passage 3F is in the full-throttling position S1, the bleed-off control passage 3F is fully throttled so that the whole flow of oil discharged from the flow dividing valve 2 which is in the first position 2A is permitted to flow to the hydraulic motor 4 and no oil is flowed to the tank T0 through the bleed-off line 7.

In the case that the flow dividing valve 2 is shifted to the second position to reduce the flow of oil supplied to the control valve 3, however, the oil discharged from the flow dividing valve 2 does not start flowing to the hydraulic motor 4 until the bleed-off control passage 3F is throttled by a partial throttling position S0'. This is because of the fact: When the flow dividing vavle 2 is in the second position 2B, a reduced flow of oil is supplied to the control valve 3. Therefore, the oil cannot have pressure enough to overcome an inertial resistance of the hydraulic motor 4 until the bleed-off control passage 3F is throttled by the partial throttling position S0'. Consequently, the slope of the portion K1 is identical with that of the portion J1.

The controllable range of the bleed-off control passage 3F of the control valve 3 is reduced when the flow dividing valve 2 is in the second position 2B. Accordingly, it will be seen that the maximum speed of the hydraulic motor 4 is changed by shifting the flow dividing valve 2, but it is impossible to finely control the speed of the hydraulic motor 4 at the reduced flow of oil.

SUMMARY OF THE INVENTION

It is an object of the present invention to provide a flow control device which makes it possible to carry out finer control of the speed of a hydraulic motor at a reduced flow of oil.

A flow control device of the present invention comprises a control valve including a discharge line to be connected to a hydraulic motor, a supply line to be connected to a hydraulic pump, a first bleed-off control passage having a line connected to a tank, and a second bleed-off control passage having a line connected to the tank through a secondary control valve, a flow dividing valve provided in the supply line and having a first position for allowing a first desired flow of oil discharged from the hydraulic pump and a second position for allowing a second desired flow of the oil, and a selector valve operable for the secondary control valve and the flow dividing valve and having a first selection position for closing the secondary control valve and shifting the flow dividing valve to the first position and a second selection position for opening the secondary control valve and shifting the flow dividing valve to the second position.

Also, the first desired flow of the flow dividing valve is the whole flow of oil discharged from the hydraulic pump and the second desired flow is a partial flow of the oil.

Accordingly, the flow control device makes it possible to control the flow of oil supplied to a hydraulic motor more finely. Also, the flow control device which has a control valve provided with the two bleed-off control passages can reduce the opening area of each bleed-off control passage and consequently requires a shortened throttling stroke. Accordingly, the flow control device of the present invention has a reduced size in entirety.

This and other objects, features and advantages of the present invention will become more apparent upon reading of the following detailed description and drawings.

DETAILED DESCRIPTION OF A PREFERRED EMBODIMENT OF THE INVENTION

Figure 1:
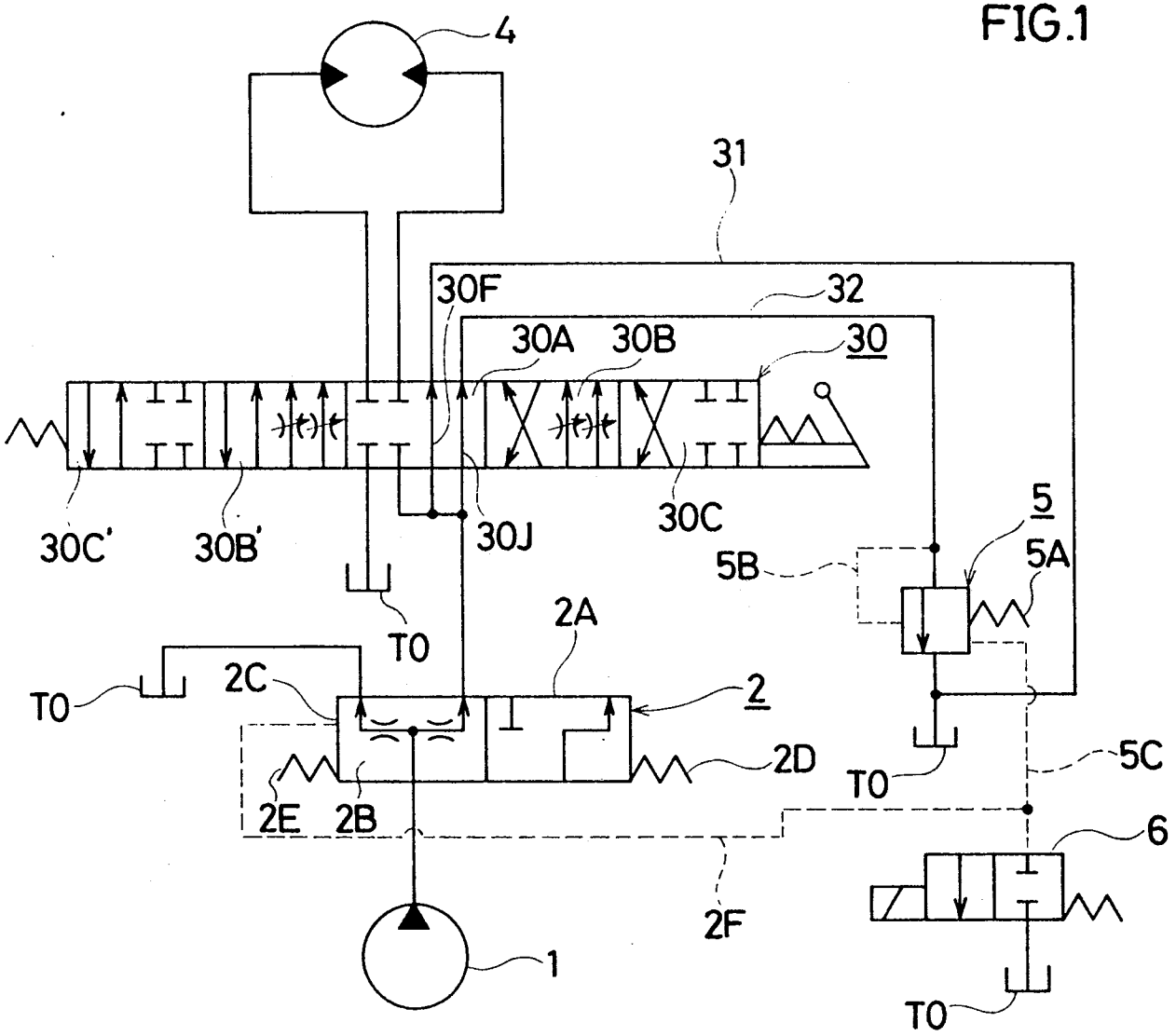
FIG. 1 is a diagram showing a hydraulic circuit of a flow control device of the present invention.
Figure 2:
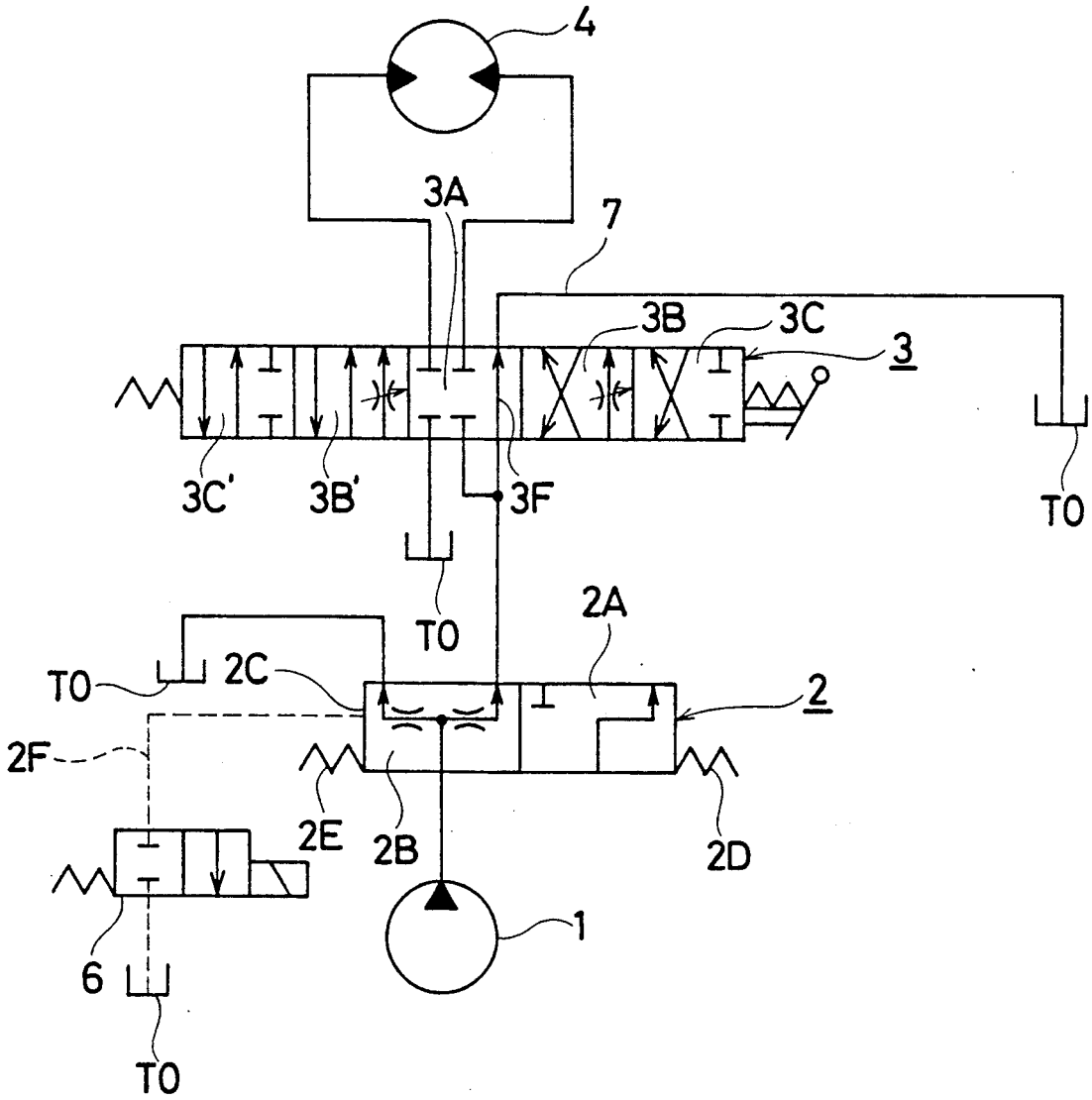
FIG.2 PRIOR ART
FIG. 2 is a diagram showing a hydraulic circuit of a conventional flow control device.

A preferred embodiment of the present invention will be described with reference to FIGS. 1 and 3. A pump 1 is communicated with a hydraulic motor 4 through a flow dividing valve 2 and a control valve 30. The flow dividing valve 2 is adopted for controlling the flow of oil supplied to the control valve 30. The control valve 30 is adopted for controlling the direction and flow of oil supplied to the hydraulic motor 4.

The flow dividing valve 2 has a first position 2A in which the whole flow of oil discharged from the pump 1 is supplied to the control valve 30, and a second position 2B in which a portion of oil discharged from the pump 1 is supplied to the control valve 30 and the remaining portion is discharged to a tank T0.

Also, the flow dividing valve 2 has a pilot port 2C to which a pilot line 2F is connected, and springs 2D and 2F. The pilot port 2C is communicated with the a tank T0 through the pilot line 2F having a selector valve 6. A portion of oil flowed into the flow dividing valve 2 is supplied to the pilot line 2F as pilot oil. When the pilot line 2F is disconnected from the tank T0 by the selector valve 6, the flow dividing valve 2 is shifted from the first position 2A to the second position 2B. When the pilot line 2F is communicated with the tank T0 by the selector valve 6, the flow dividing valve 2 is shifted from the second position 2B to the first position 2A.

The control valve 30 has a neutral position 30A, a first control position 30B, and a second control position 30C.

In the neutral position 30A, a line between the hydraulic motor 4 and the pump 1 and a line between the hydraulic motor 4 and the tank T0 are closed, and a first bleed-off control passage 30F and a second bleed-off control passage 30J are opened.

In the first control position 30B, both the line between the hydraulic motor 4 and the pump 1 and the line between the hydraulic motor 4 and the tank T0 are opened, and the first bleed-off control passage 30F and the second bleed-off control passage 30J are throttled.

In the second control position 30C, both the line between the hydraulic motor 4 and the pump 1 and the line between the hydraulic motor 4 and the tank T0 are opened, and the first bleed-off control passage 30F and the second bleed-off control passage 30J are closed.

Also, the control valve 30 has a reverse first control position 30B' and a reverse second control position 30C' which have the same functions as the first and second control positions 30B and 30C but the reverse flow directions to the first and second control positions 30B and 30C.

The first bleed-off control passage 30F is communicated with the tank T0 through a line 31. The second bleed-off control passage 30J is communicated with the tank T0 through a line 32 provided with a secondary control valve 5. Also, the first bleed-off control passage 30F and the second bleed-off control passage 30J have such respective opening areas that when the two bleed-off control passages 30F and 30J are in the full-open, the two bleed-off control passages 30F and 30J can discharge the whole flow of oil supplied from the flow dividing valve 2 which is in the first position 2A.

The secondary control valve 5 has a spring 5A, a pilot line 5B for producing oil pressure against the spring 5A, and a pilot line 5C connected to the selector valve 6. The pilot line 5C is supplied with oil from the line 32 through the secondary control valve 5.

When the pilot line 5C is communicated with the tank T0 through the selector valve 6, the secondary control valve 5 is opened by the oil supplied from the pilot line 5B, so that the line 32 comes into communication with the tank T0. Accordingly, both the first bleed-off control passage 30F and the second bleed-off control passage 30J are communicated with the tank T0.

Also, the pilot line 5C is communicated with the pilot port 2C of the flow dividing valve 2 through the pilot line 2F. The communication of the pilot lines 5C, 2F with the tank T0 is controlled by the selector valve 6.

Accordingly, when the selector valve 6 is opened, the bleed-off control passage 30J comes into communication with the tank T0 owing to the fact that the secondary control valve 5 is opened, and the flow dividing valve 2 is simultaneously shifted to the first position 2A.

Consequently, the whole flow of oil discharged from the pump 1 is supplied to the control valve 30. On the other hand, when the selector valve 6 is closed as shown in FIG. 1, the bleed-off control passage 30J is disconnected from the tank T0 owing to the fact that the secondary control valve 5 is closed, and the flow dividing valve 2 is simultaneously shifted to the second position 2B. Consequently, a reduced flow of oil is supplied to the control valve 30. It will be seen that the opening and closing of the selector valve 6 cause both shifting of the flow dividing valve 2 and communication of the bleed-off control valve 30J with the tank T0.

Next, operation of this flow control device will be described. When the selector valve 6 is closed, the flow dividing valve 2 is shifted to the second position 2B. Consequently, a portion of oil discharged from the pump 1 is flowed to the tank T0 and the remaining portion is supplied to the control valve 30.

In the control valve 30, the second bleed-off control passage 30J is disconnected from the tank T0 by the secondary control valve 5. The first bleed-off control passage 30F is communicated with the tank T0. Consequently, only the first bleed-off control passage 30F is used for flow control.

When the control valve 30 is in the neutral position 30A as shown in FIG. 1, the whole flow of oil discharged from the flow dividing valve 2 is flowed to the tank T0 through the line 31 and no oil is supplied to the hydraulic motor 4.

When the control valve 30 is shifted to the first control position 30B, both the line between the hydraulic motor 4 and the pump 1 and the line between the hydraulic motor 4 and the tank T0 are opened, and the first bleed-off control passage 30F is throttled. The flow of oil supplied to the hydraulic motor 4 increases with throttling of the first bleed-off control passage 30F. This increase is represented by a portion L1 of a performance curve L.

In this embodiment, it is possible to start flowing oil to the hydraulic motor 4 immediately after throttling the first bleed-off control passage 30F a little because of the fact that the full-opened area of the first bleed-off control passage 30F is smaller and the second bleed-off control passage 30J is hindered from flowing to the tank T0. Accordingly, the flow control is executable from the full-opening position S0 to the full-throttling position S1.

When the control valve 30 is shifted to the second control position 30C, the two first and second bleed-off control passages 30F, 30J are closed and the whole flow of oil supplied from the flow dividing valve 2 is supplied to the hydraulic motor 4. This flow control corresponds to a portion L2 of the performance curve L.

When the selector valve 6 is opened, the pilot line 5C is communicated with the tank T0. Consequently, the flow dividing valve 2 is shifted to the first position 2A, so that the whole flow of oil discharged from the pump 1 is supplied to the control valve 30. Also, the secondary control valve 5 is opened owing to the fact that the pilot line 5C is communicated with the tank T0. Consequently, the second bleed-off control passage 30J is communicated with the tank T0. Both the first bleed-off control passage 30F and the second bleed-off passage control 30J are used for flow control.

The control valve 30 is shifted to the first control position 30B and the flow of oil supplied to the hydraulic motor 4 is controlled by throttling the first and second bleed-off control passages 30F and 30J. This flow control corresponds to the portion K1 of the performance curve K.

Figure 3:
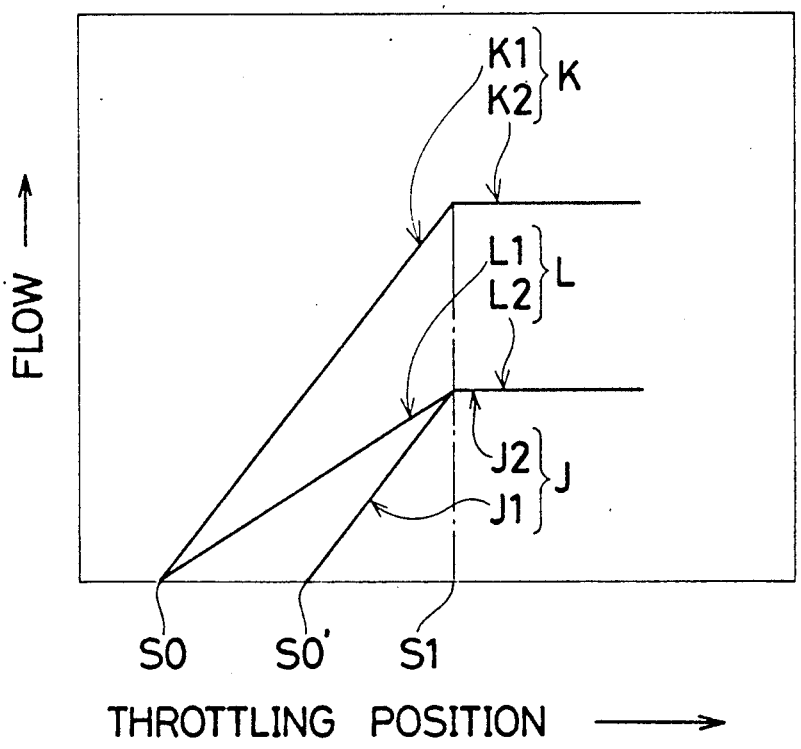
FIG. 3 is a diagram showing relationships between oil flow to a hydraulic motor, throttling of a bleed-off control passage of a control valve, and shifting of a flow dividing valve.

It will be seen in FIG. 3 that the flow control is carried out more gently or finer when the flow dividing valve 2 is in the second position than when the flow dividing valve 2 is in the first position.

It will be noted that the slope of the portion L1 is an example and can be desirably changed by adjusting the opening areas of the bleed-off control passages 30F and 30J.

Also, although this embodiment uses a flow dividing valve which divides the flow of oil discharged from the pump 1 at a given proportion, it will be noted that it is allowable to use a priority flow dividing valve capable of supplying a fixed flow of oil supplied to the control valve.

Further, it would be understood that the foregoing relates to only the scope of the present invention as defined by the appended claims rather than by the description preceding them, and all changes that fall within metes and bounds of the claims, or equivalence of such metes and bounds are therefore intended to be embraced by the claims.

What is claimed is:

1. A flow control device comprising:

a control valve including a discharge line to be connected to a hydraulic motor, a supply line to be connected to a hydraulic pump, a first bleed-off control passage having a line connected to a tank, and a second bleed-off control passage having a line connected to the tank through a secondary control valve;

a flow dividing valve provided in the supply line, and having a first position for allowing a first desired flow of oil discharged from the hydraulic pump and a second position for allowing a second desired flow of the oil; and a selector valve operable for the secondary control valve and the flow dividing valve, and having a first selection position for closing the secondary control valve and shifting the flow dividing valve to the second position and a second selection position for opening the secondary control valve and shifting the flow dividing valve to the first position.

2. A flow control device according to claim 1 wherein the first desired flow is the whole flow of the oil discharged from the hydraulic pump and the second desired flow is a partial flow of the oil.

* * * * *